United States Patent [19]

Grove

[11] 4,092,807

[45] June 6, 1978

[54] WHEEL CLAMPING DEVICE

[75] Inventor: George Luther Grove, Cincinnati, Ohio

[73] Assignee: Cincinnati Milacron Inc., Cincinnati, Ohio

[21] Appl. No.: 749,466

[22] Filed: Dec. 10, 1976

[51] Int. Cl.[2] ..... B24B 41/00

[52] U.S. Cl. ..... 51/168

[58] Field of Search ..... 51/168, 207; 52/573; 85/62, 38

[56] References Cited

U.S. PATENT DOCUMENTS

| | | | |
|---|---|---|---|
| 566,883 | 9/1896 | Alden et al. | 51/168 |
| 1,998,919 | 4/1935 | Ball et al. | 51/168 |

FOREIGN PATENT DOCUMENTS

| | | | |
|---|---|---|---|
| 498,502 | 5/1930 | Germany | 51/168 |

*Primary Examiner*—Harold D. Whitehead
*Attorney, Agent, or Firm*—Thomas M. Farrell

[57] ABSTRACT

A machine has a rotatable spindle adapted to carry a work-contacting wheel which is end-wise supported between a spindle flange and a clamping flange. A flat circular plate and belleville spring disc are disposed between a side of the wheel and the spindle flange, and the belleville spring disc is compressed to such loaded position that minor changes in its loaded height will not substantially affect the spring load, and thereby minor changes in the spindle length and/or wheel width may be accommodated without appreciably affecting the clamping forces on the grinding wheel.

3 Claims, 6 Drawing Figures

WHEEL CLAMPING DEVICE

BACKGROUND OF THE INVENTION

In grinding machines, it is necessary to support a grinding wheel on a rotatable machine spindle. The grinding wheel is most often carried on a spindle diameter which fits closely within a central bore in the wheel, and the end faces of the grinding wheel are clamped between a spindle flange and a separate clamping flange which is adapted to be secured to the spindle by a nut, or a plurality of screws, for example. The load which is impressed on the grinding wheel faces by the spindle flange and the clamping flange gives rise to a frictional grip by the flanges on the wheel for torque transmission.

For relatively thin grinding wheels, any changes in wheel width and/or the supporting spindle length in the wheel bore, which may be experienced because of thermal excursions, does not appreciably affect the clamping force exerted by the flanges. However, when a relatively wide grinding wheel is employed, for example, as often encountered in centerless grinding art, which may be in the nature of twenty inches or so, the thermal changes experienced by the supporting grinding wheel spindle may result in such dimensional changes as to appreciably affect the clamping force. If a wheel were put on a cold spindle and clamped to the proper load, as the spindle temperature reaches steady state running conditions, thermal growth of the spindle may tend to lessen the clamping forces on the grinding wheel.

By way of example, a wheel spindle made of steel, has a thermal coefficient of expansion of $6 \times 10^{-6}$ inches per inch of length per degree Fahrenheit, and, for a 20 inch spindle length at a 30° F temperature change, the spindle change in length would calculate to be 0.0036 inches.

Load on the wheel faces is conventionally obtained by tightening the screws to the same torque reading with a torque wrench, the assumption being that the torque is directly proportional to axial load on the screw. While theoretically so, an actual assembly includes variable elements which are manifested in the torque reading, such as tightness of the thread fit. A better way to indicate axial clamping force is to measure axial position of a clamping member. Accordingly, a gaging ring has been provided in the design of the wheel clamping device of the within invention to measure axial position of the clamping member to correspond to a predetermined axial force.

Therefore, to obviate the difficulties inherent in the prior art, a wheel clamping device is provided, suitable for application to a wheel supporting spindle, which will accomodate certain changes in wheel width and/or spindle length without appreciably affecting the clamping force on the wheel.

It is therefore an object of the present invention to provide a wheel clamping device which will accomodate changes in wheel width and/or spindle length without appreciably affecting the wheel clamping forces.

Another object of the present invention is to provide a wheel clamping device which is capable of being easily installed and readily gaged as to proper load.

Still another object of the present invention is to provide a wheel clamping device which is non-dependent on a torque wrench for proper load.

SUMMARY OF THE INVENTION

The invention is shown embodied in a grinding machine having a rotatable spindle which is adapted to carry a work-contacting wheel wherein the wheel is end-wise supported between a spindle shoulder and a clamping flange, and an improved wheel clamping device comprises a relatively rigid circular plate and a belleville spring disc in tandem which are interposed between a side of the wheel and the spindle flange wherein clamping the spindle assembly to a predetermined preload of the spring disc accomodates spindle dimensional changes without appreciably affecting the clamping force on the wheel.

The spring disc has a gaging collar around its central bore at the apex end of its truncated conical shape where, compression of the spring disc to such position that the conical faces of the disc are parallel to one another and substantially normal to the central axis, establishes a gaging dimension between the spindle shoulder and the spring disc equal to the height of the gaging ring, so that by use of an ordinary feeler gage, the wheel may be clamped to such preloaded dimension corresponding to a proper preload force.

DESCRIPTION OF THE PREFERRED EMBODIMENT

Figure 1:
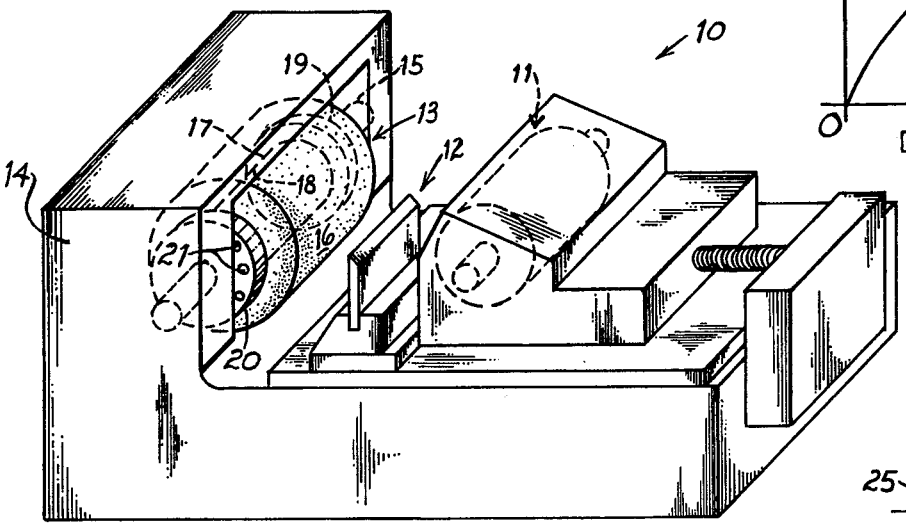
FIG. 1 is a perspective view of a grinding machine having a work contacting wheel.

Referring now to the drawings and particularly to FIG. 1 thereof, there is shown a centerless grinding machine 10, which is well-known in the art. FIG. 1 depicts a regulating wheel assembly 11, a workrest assembly 12 for supporting a workpiece (not shown) during the grinding process, and a grinding wheel assembly 13, carried in the machine wheelhead 14. The grinding wheel assembly 13 consists primarily of a rotatable grinding wheel spindle 15 which is journaled in the wheelhead 14, and the spindle 15 supports a grinding wheel 16, carrying the grinding wheel 16 on a spindle diameter 17 which fits closely within the central bore 18 of the grinding wheel 16. A spindle flange 19 is integral with the spindle 15 and a separate clamping flange 20 is adapted to be secured to the spindle 15 by screws 21 so as to draw the flanges 19, 20 together and clamp the wheel 16.

Figure 2:
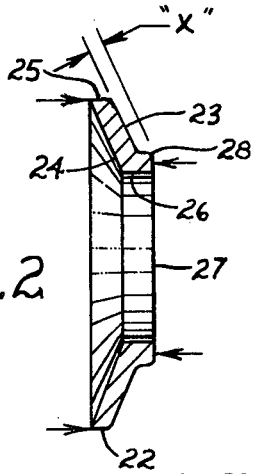
FIG. 2 is an elevational section through a belleville type spring disc.

FIG. 2 depicts a spring disc 22 of the belleville type, wherein the disc 22 has a frusto-conical shape with parallel wall faces 23, 24 extending from the base of the cone at the outer diameter 25 of the disc 22, generally to a central bore 26 through the apex end 27 of the cone. A circular gaging ring 28 is provided around the external apex end 27 of the cone, concentric with the core 26, wherein the height, "X," of the gaging ring 28 (relative to the concial wall), is useful for determining a preloaded condition of the disc 22. The spring is loaded by applying force in the direction of the arrows.

Figure 3:
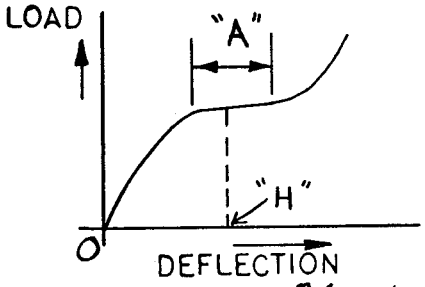
FIG. 3 is a load-deflection graph for a belleville type spring disc.

The load-deflection graph shown in FIG. 3 illustrates that the load increases as the disc is deflected, to an inflection zone on the curve, designated "A," wherein the load remains substantially constant for a continued deflection of the spring, and thereafter, the load continues to increase with deflection. The gage ring dimension, "X," is selected to represent a spring disc deflection "H" (measured axially on the disc) which intercepts zone "A" at approximately midpoint, so that slight positive or negative deflection from position "H," will not appreciably affect the load of the disc in the assembly.

Figure 4:
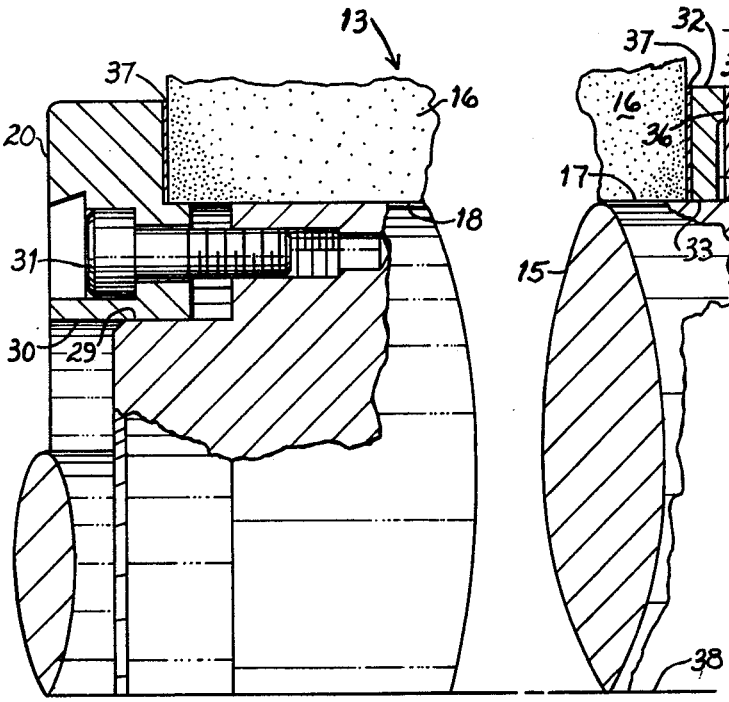
FIG. 4 is an elevational section through a grinding wheel spindle assembly.
Figure 4:
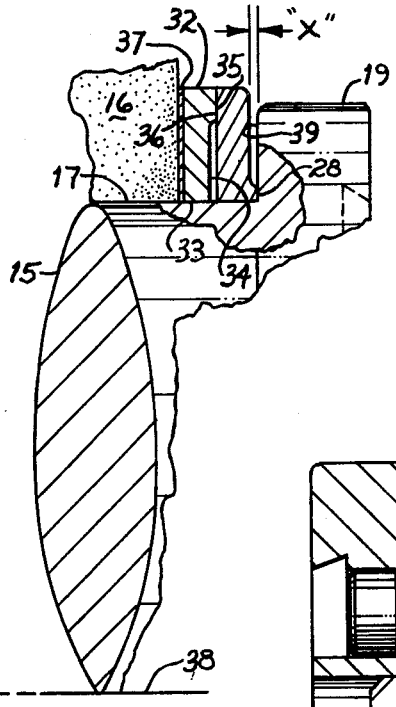

The section shown in FIG. 4 illustrates a clamped grinding wheel assembly 13, wherein the grinding wheel 16 has a central bore 18 which is adapted to be received on a close-fitting diameter 17 of the grinding wheel spindle 15. The spindle 15 has an integral spindle flange 19, and a clamping flange 20 is adapted to be received on another diameter 29 of the spindle 15 which extends into a close-fitting bore 30 in the clamping flange 20. The clamping flange 20 is drawn securely to the spindle 15 by clamping screws 31. A relatively stiff circular plate 32 is placed on the grinding wheel spindle 15, at a position adjacent to the grinding wheel 16 between the grinding wheel 16 and the spindle flange 19. The plate 32 is cylindrical in shape, having a central bore 33 to be received on the spindle diameter 17. A face relief 34 is provided to accomodate movement of the spring disc 22, so that only a rim 35 remains to be contacted by the outer portion 36 of the spring disc 22, thus tending to remove higher wheel stresses, impressed by the clamping force, away from the wheel bore 18. The spring disc 22 is received between the circular plate 32 and the spindle flange 19, wherein the spring disc 22 is received against the rim 35 of the plate 32, and the gaging ring 28 at the apex end 27 of the disc 22 is in contact with the spindle flange 19. In practice, it is conventional to place paper sheets 37 immediately adjacent to the wheel to smooth and cushion the wheel surface.

Figure 5:
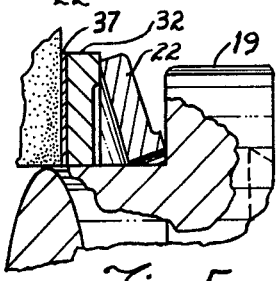

At initial assembly, as depicted in FIG. 5, the spring disc 22 is in a relaxed state, in its frusto-conical shape. When the assembly 13 is drawn together by the clamping screws 31 (which may be torqued by a suitable wrench), as in FIG. 4, the spring disc 22 will become preloaded at the desired position where the parallel wall surfaces 23, 24 of the disc 22 are substantially normal to the central axis 37 of the spindle 15, and the dimension "X" of the gaging ring will be the dimension between the spring disc 22 and the clamping surface 39 of the spindle flange 19. Therefore, a conventional feeler gage may be inserted, and, as the assembly is drawn up tight, the feeler gage will become snuggly fitted, detecting dimension "X," with relative ease. Thereafter, as the spindle and/or wheel may be subjected to thermal excursions, any relative growth or shrinkage may be accomodated by movement of the spring disc, without an appreciable change in the clamping load which has been applied to the grinding wheel, and the torque transmitting frictional force will therefore remain essentially constant, insuring constancy for the machine assembly.

Figure 6:
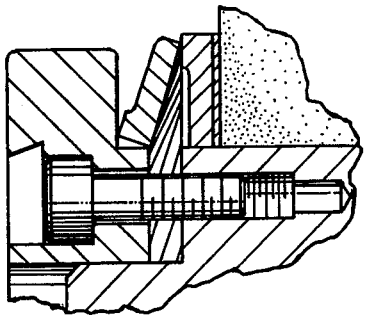

FIG. 6 is an alternative embodiment of the invention, showing the circular plate 32 and spring disc 22 interposed between the grinding wheel 16 and clamping flange 20 and cooperating as hereinbefore described.

It is not intended to limit the invention to the specific embodiments shown herein, but rather the invention extends to all such designs and modifications as come within the scope of the appended claims.

What is claimed is:

1. In a machine tool having a rotatable spindle with a spindle diameter adapted to support a cutting wheel, a spindle flange radially adjacent to the spindle diameter, and a clamping flange which is securable to the spindle so as to clamp a cutting wheel disposed between the flanges, an improved wheel clamping device comprising:

(a) a belleville-type spring disc interposed between said wheel and one of said flanges and coaxial therewith, adapted for compression to a working deflection, said spring disc thereby accommodating an interval of positive or negative spring deflection from the working deflection, yet maintaining a substantially constant working load throughout said interval;

(b) a plate adapted to be interposed between said spring disc and a side of a clamped wheel; and (c) a face relief in said plate to accommodate spring disc movement.

2. In a machine tool having a rotatable spindle with a spindle diameter adapted to support a cutting wheel, a spindle flange radially adjacent to the spindle diameter, and a clamping flange which is securable to the spindle so as to clamp a cutting wheel disposed between the flanges, an improved wheel clamping device, comprising:

(a) a belleville-type spring disc interposed between said wheel and one of said flanges and coaxial therewith, adapted for compression to a working deflection, said spring disc thereby accommodating an interval of positive or negative spring deflection from the working deflection, yet maintaining a substantially constant working load throughout said interval; and (b) an integral gaging ring at the apex end of said belleville-type spring disc to indicate said working deflection of said disc.

3. In a machine tool having a rotatable spindle with a spindle diameter adpated to support a cutting wheel, and a spindle flange radially adjacent to the spindle diameter, and a clamping flange which is securable to the spindle so as to clamp a cutting wheel disposed between the flanges, and improved wheel clamping device, comprising:

(a) a belleville-type spring disc interposed between said wheel and one of said flanges and coaxial therewith, adapted for compression to a working deflection, said spring disc thereby accomodating an interval of positive or negative spring deflections from the working deflection, yet maintaining a substantially constant working load throughout said interval; and (b) a disc gaging means to indicate said working deflection of said disc.

* * * * *